US006637692B1

(12) United States Patent
Jacobsson

(10) Patent No.: US 6,637,692 B1
(45) Date of Patent: Oct. 28, 2003

(54) YARN FEEDING DEVICE AND YARN BRAKING BODY

(75) Inventor: Kurt Arne Gunnar Jacobsson, Ulricehamn (SE)

(73) Assignee: Iropa AG, Baar (CH)

( * ) Notice: Subject to any disclaimer, the term of this patent is extended or adjusted under 35 U.S.C. 154(b) by 0 days.

(21) Appl. No.: 09/936,575

(22) PCT Filed: Mar. 16, 2000

(86) PCT No.: PCT/EP00/02362

§ 371 (c)(1),
(2), (4) Date: Feb. 11, 2002

(87) PCT Pub. No.: WO00/55081

PCT Pub. Date: Sep. 21, 2000

(30) Foreign Application Priority Data

Mar. 17, 1999 (DE) ..... 199 11 943

(51) Int. Cl.[7] ..... B65H 51/20; D03D 47/36
(52) U.S. Cl. ..... 242/365.4; 139/452
(58) Field of Search ..... 242/365.1, 365.4, 242/419.4; 139/452

(56) References Cited

U.S. PATENT DOCUMENTS 4,429,723 A * 2/1984 Maroino ..... 139/452
5,343,899 A * 9/1994 Jacobsson et al. ..... 139/452
5,409,043 A * 4/1995 Zenoni et al. ..... 139/452
5,546,994 A * 8/1996 Sarfati ..... 139/452
5,678,779 A * 10/1997 Maina ..... 242/365.4
5,769,132 A * 6/1998 Tholander et al. ..... 242/365.4
6,125,892 A * 10/2000 Fritzson ..... 139/452
6,257,516 B1 * 7/2001 Fritzson et al. ..... 242/365.4
6,322,016 B1 * 11/2001 Jacobsson et al. ..... 242/365.4

FOREIGN PATENT DOCUMENTS

| | | |
|---|---|---|
| WO | WO 94/20402 | 9/1994 |
| WO | WO 95/00431 | 1/1995 |
| WO | WO 98/38124 | 9/1998 |
| WO | WO 99/64337 | 12/1999 |

* cited by examiner

*Primary Examiner*—Michael R. Mansen
(74) *Attorney, Agent, or Firm*—Flynn, Thiel, Boutell & Tanis, P.C.

(57) ABSTRACT

A yarn feeder including a stationary storage body and a yarn brake having a brake element which axially contacts the storage body. The brake element is embodied by a truncated cone-shaped, thin-walled braking band which is held externally in an elastic, circular retaining membrane joined to a carrier ring that is concentric to the brake band. At least outside the retaining area for the brake band, several areas having a reduced wall thickness are provided in the retaining membrane.

21 Claims, 2 Drawing Sheets

YARN FEEDING DEVICE AND YARN BRAKING BODY

FIELD OF THE INVENTION

The invention relates to a yarn feeding device including a stationary storage body and a yarn brake incorporating a braking body which is held axially against the storage body, and a yarn braking body for a yarn feeding device.

BACKGROUND OF THE INVENTION

The braking body of a yarn brake of a yarn feeding device known from EP-A-06 86 128, well known in the market under the name "flex brake", comprises an annular rubber or plastic material membrane of circumferentially constant wall thickness. Arc-shaped bending zones are provided between the holding area of the braking band and the carrier ring. The holding membrane has an annular skirt which grips over the rear side of the braking band which is glued to the skirt. When mounted at the yarn feeding device the yarn braking body braking band is held by axial pre-tensioning force against a rounded withdrawal rim of the storage body. When withdrawn the yarn runs over the withdrawal rim and below the braking band which defines a circumferentially continuous braking surface and has a generally line-shaped contact area on the withdrawal rim. At the location of the yarn passage the braking band is lifted from the withdrawal rim and forms a sickle-shaped intermediate space. Since the withdrawn yarn fulfills an orbiting motion about the withdrawal rim, the sickle-shaped intermediate space moves with the yarn. The yarn additionally actuates the braking band by a friction force resulting in a slight local deformation of the braking band such that the basically unstretchable but elastically bendable braking band may form waves. The holding membrane transferring the axial pre-tensioning force into the braking band follows the operational movements of the braking band. From the local deformations of the braking band the contact pressure at the withdrawal rim of the storage body may vary leading to an irregular behaviour of the yarn tension in the withdrawn yarn. This influences the self-compensation performance of the yarn brake. The self-compensation performance means that the braking band automatically decreases the braking effect when the yarn tension increases by strong yarn acceleration, and vice versa increases the braking effect when the yarn tension automatically decreases due to a strong yarn deceleration, in order to maintain a uniform yarn tension profile.

In one embodiment (FIGS. 14, 15) of a yarn brake for a yarn feeding device as known from WO-A-98/38124, the braking band is floatingly suspended at its rear side on a conical elastic ring body. In the contact area of the ring body, circumferentially consecutive elevations and depressions may be provided. In the embodiment shown in FIG. 16 the braking is held at its outer edge region within a circumferentially extending pocket of an elastic annular holding membrane which is connected outside of the holding area to a carrier ring arranged concentrically with respect to the braking band. Between the carrier ring and the holding area of the braking band, the holding membrane has a circumferentially continuous wall thickness.

It is an object of the invention to improve a yarn feeding device as mentioned above as well as a yarn braking body such that in operation a tension profile can be achieved in the withdrawn yarn, which tension profile is as uniform as possible, and that undefined deformation actions are minimized in the braking band.

The above object is achieved by providing an elastic holding membrane which holds the braking band of the braking body by its outer edge region, and the holding membrane has a plurality of area portions with a reduced wall thickness between a carrier ring and the area of the holding membrane which holds the braking band.

Unexpectedly, the support of the braking band in the holding membrane is improved by the area portions each having a reduced wall thickness. Spring spokes are defined between adjacent area portions, and the spring spokes mainly transmit the forces from the carrier ring into the braking band. The spring spokes may be formed with the normal wall thickness of the holding membrane. The wall thickness in the area portions is significantly smaller. The area portions of reduced wall thickness form intermediate spaces between the spring spokes. At least adjacent to the holding area, the intermediate spaces are filled out by swim skin like membrane layers. The area portions may have a randomly selectable shape and occupy a selectable part of the overall usable area. The wall thickness of the holding membrane or its degree of hardness may be higher than in the known holding membrane such that the holding rigidity for the braking band is higher and improves the centering of the braking band on the withdrawal rim. During withdrawal of the yarn, a controlled deformation of the holding membrane between the holding area and the carrier ring is achieved by means of the area portions. Undefined deformations of the braking band otherwise resulting in irregularities of the yarn tension are compensated for or are dissipated. During the orbiting motion of the yarn, the area portion situated close to the withdrawal point takes up forces. The area portion gets deformed, e.g. by buckles or depressions, and assists in avoiding undefined deformation of the braking band. The yarn tension profile in the withdrawn yarn is made more uniform. The braking band operates in a desirably damped manner since the area portions of reduced wall thickness result in a lazy response behaviour of the holding membrane. The important self-compensation performance is assured even with the highest yarn withdrawal speeds and for difficult yarn qualities. Thanks to the swim skins in the area portions, no openings are formed in which lint would otherwise deposit or the yarn would be caught, particularly when being threaded through the yarn brake. Finally, manufacturing of the holding membrane and of an injection molding tool are simpler if in view of a predetermined deformation performance between the holding area and the carrier ring and if the area portions influencing the deformation behaviour are not formed open but with reduced wall thickness.

In circumferential direction the area portion may be distributed regularly.

In order to achieve a soft, relatively damped spring property of the holding membrane the holding membrane ought to be formed with at least one bend between the holding area and the carrier ring. In this bend the spring spokes are acting like bending springs transmitting the forces to the braking band.

Expediently, the circumferential widths of the area portions are different from the circumferential widths of the spring spokes, and are preferably smaller. However, it is possible to provide about the same circumferential widths for the area portions and the spring spokes.

The ratio between the wall thickness in the area portions and the wall thickness of the spring spokes should be about 1:5.

Expediently, the area portions as well as the spring spokes are oriented substantially radially. Said orientation allows use of the yarn braking body irrespective of the withdrawal direction of the yarn from the storage body for each withdrawal direction. Furthermore, said orientation results in an efficient centering of the braking band on the storage body, irrespective of the yarn withdrawal direction.

The area portions may have a substantially oval shape. This also is of advantage for manufacturing the braking body.

The area portions and the spring spokes should define an essentially smooth surface at the convex side of the bend. Said surface facing the incoming direction of the yarn assures that no lint is collected and that the yarn is not caught when touching the surface. The area portions having the reduced wall thickness may be under pre-tension in the surface, i.e. so that the thin membrane layer bridging the intermediate space so to speak is in a stretched condition in one or several directions.

Expediently, the bend is prolongated inwardly by a conical skirt having smooth surfaces. The skirt supports the braking band at its rear side and damps an excessively lively spring behaviour of the braking band.

A protruding lip may be formed in the holding area. The lip defines with the skirt an open insertion pocket for the braking band. The braking band may be glued to the skirt. In most cases it is sufficient to only insert the braking band into the insertion pocket and to loosely secure it in operative position exclusively by the form fit. In operation the position of the braking band anyway is fixed by the contact pressure of the braking body and the contact between the braking band and the skirt.

Said lip may protrude by a distance amounting to about 10% to 25% of the width of the braking band. Said dimension facilitates mounting or inserting or removing the braking band and nevertheless assures a proper positioning of the braking band, even during transport of the braking body.

The area portions having the reduced wall thickness should begin a short distance outside of the insertion pocket in which the braking band is positioned by its outer edge.

The wall thickness of the skirt may be smaller than the wall thickness of the spring spokes but larger than the wall thickness in the area portion.

The holding membrane expediently is a unitary injection molded part made from a tough elastic plastic material, such as polyurethane. The spring spokes which are important for the function of the holding membrane and act one by one due to the provision of the softer interspaces can be formed by simple tooling if the intermediate spaces are bridged by thin layers of the material of the holding membrane. Said design significantly simplifies the manufacturing process of the holding membrane by injection molding and leads to the advantage that the intermediate spaces, thanks to the swim skins, participate in the energy distribution or damping energy dissipation and support the braking band.

BRIEF DESCRIPTION OF THE DRAWINGS

An embodiment of an object of the invention will be explained with the help of the drawings, in which.

DETAILED DESCRIPTION

Figure 1:
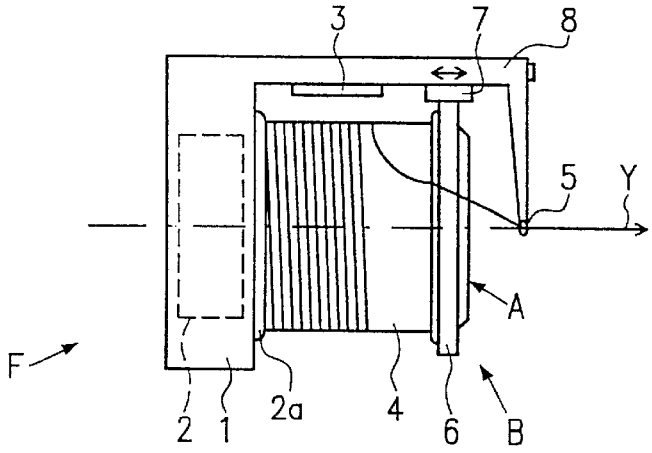
FIG. 1 is a schematic side view of a yarn feeding device having a yarn brake.
Figure 3:
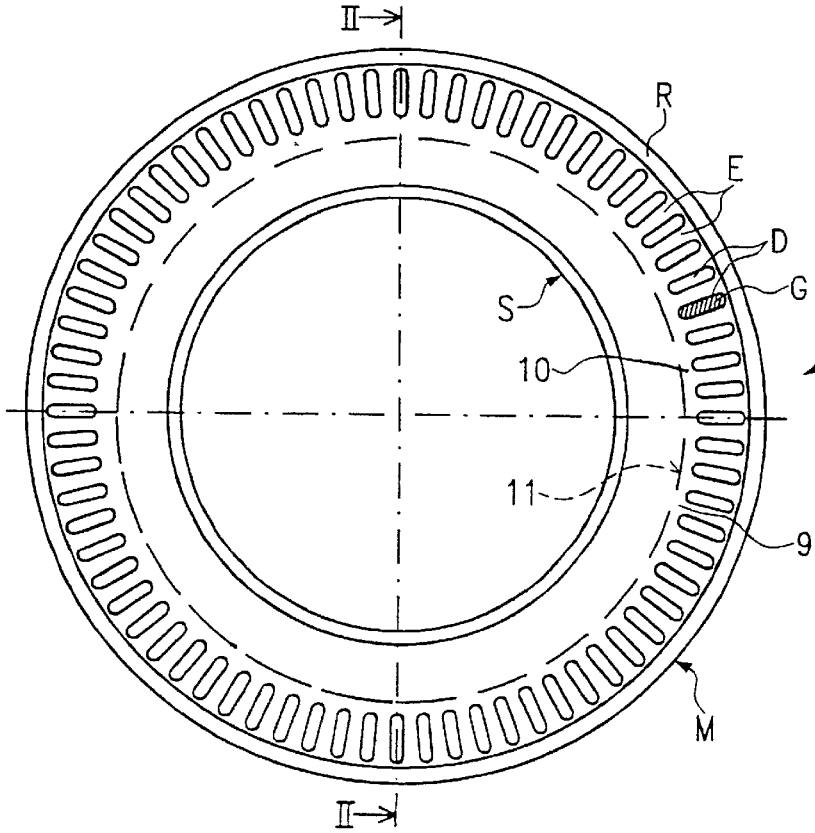
FIG. 3 is a rear view of the yarn braking body of FIG. 2.
Figure 2:
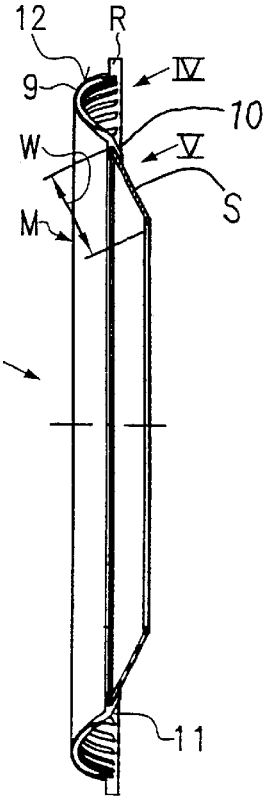
FIG. 2 is an axial section of a yarn braking body as used in the yarn brake of FIG. 1.
Figure 4:
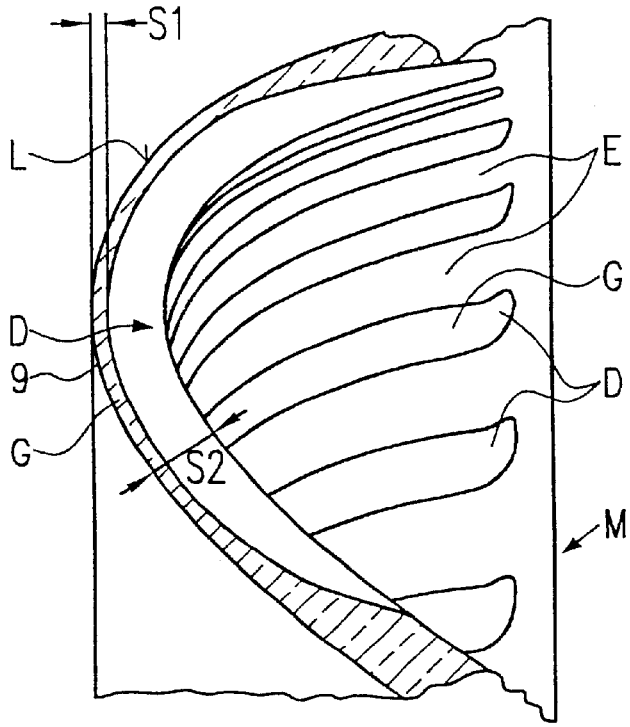
FIG. 4 is a magnified section of the sectional view of FIG. 2.
Figure 5:
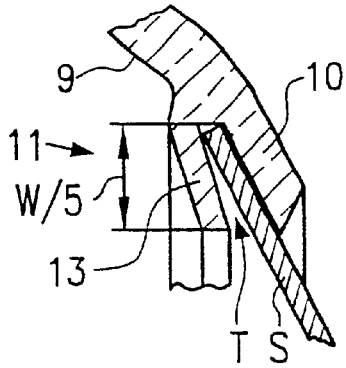
FIG. 5 is a further magnified section from FIG. 2.

A yarn feeding device F in FIG. 1 has the task to pull a yarn Y from a yarn bobbin (in FIG. 1, left side, not shown), to intermediately store the yarn in turns on a stationary storage body 4, and to allow a textile machine, e.g. a weaving machine, to withdraw said yarn through a yarn brake B with essentially constant yarn tension, which yarn brake B is structurally integrated into said yarn feeding device F. A rotary drive 2 for a winding element 2*a* is provided in a housing 1. The rotary drive 2 and the winding element 2*a* intermediately store the yarn on the storage body in a yarn supply the size of which always is sufficient to cover the momentary consumption of the textile machine. A housing bracket 8 carries a withdrawal eyelet 5. A sley 7 is adjustable along said housing bracket 8. Adjustments of said sley 7 vary the braking effect. Sley 7 carries a carrier 6 which holds a ring-shaped yarn braking body A such that yarn braking body A is pressed with a frustoconical braking band S against a rounded withdrawal rim of the storage body 4 (FIG. 2). During withdrawal of the yarn Y, the yarn Y is pulled through between the withdrawal rim and the inner surface of the braking band S, and the yarn withdrawal point orbits around the withdrawal rim.

The yarn braking body A shown in FIGS. 2 to 5 with differing details has an annular holding membrane M made from rubber or plastic material, e.g. from polyurethane. Holding membrane M may be made transparent. Expediently, holding membrane M is a unitary injection molded part. A frustoconical, endless braking band S is positioned in the inner portion of said holding membrane M. Braking band S preferably is made from a metal alloy. Alternatively, holding membrane M could be made from a compound material, e.g. with the use of Kevlar. Adjacent to a circular holding area 11, a conical skirt 10 extends inwardly in said holding membrane M. Said skirt bears against the rear side of braking band S and almost extends to the inner edge region of said braking band S. Outside of holding area 11, holding membrane M is formed with a generally C-shaped bend L which extends via an essentially 90° transition into an outer carrier ring R. Carrier ring R is concentric to braking band S. Optionally, carrier ring R may be made as a separate structural component and connected with holding membrane M.

The bend L defines an outer annular region 9 of holding membrane M. Said outer annular region 9 contains area portions D (FIG. 4) each having reduced wall thickness S1 smaller than the normal membrane wall thickness S2. Said area portions D are distributed in the circumferential direction. The area portions D e.g. form oval intermediate spaces (FIG. 3) between spring spokes E each e.g. of wall thickness S2. Said spring spokes are arranged essentially like beams and are integrated into the annular region 9 of holding membrane M. The ratio between wall thickness S2 and wall thickness S1 may be about 5:1. In case of a wall thickness S2 of about 1.0 mm, wall thickness S1 may be about 0.2 mm. At the side where yarn Y runs below braking band S, annular region section 9 is formed with an essentially smooth surface 12. At the rear side within annular region section 9, groove-shaped depressions are formed due to the reduced wall thickness S1. The area portions D can be formed oval and may be oriented essentially radially with respect to the axis of yarn braking body A. This is also true for spring spokes E.

Figure 6:
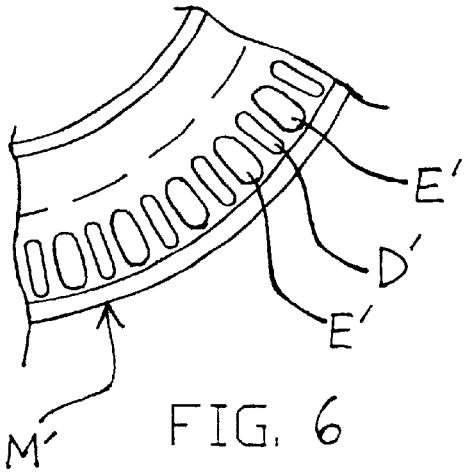
FIG. 6 is a fragmentary view of an alternative embodiment of the yarn braking body.

In the shown embodiment, the area portions D have the same widths in the circumferential direction like the spring spokes E. FIG. 6 shows an alternative embodiment of a braking band having a holding membrane M'. In this embodiment, the widths of the area portions D', however, are different (e.g. smaller) than the widths of spring spokes E'. The area portions D commonly begin at a distance from holding area 11 for braking band S. In holding area 11 a circumferentially continuous lip 13 (FIG. 5) extends freely inwardly. Lip 13 and skirt 10 form an insertion pocket T for the outer edge of braking band S. Said insertion pocket is inwardly open and extends around the circumference. The free length of lip 13 e.g. corresponds to a fifth of the width W of braking band S. Insertion pocket T is located essentially in the same radial plane as the transition from the annular region 9 into the carrier ring R.

Alternatively, lip 13 could be omitted. Then braking band S could be secured at skirt 10 by gluing.

The radial extension of annular region 9 of holding membrane M essentially corresponds to the radial extension of braking band S. The wall thickness of skirt 10 may be smaller than wall thickness S2 of the spring spokes E but should be larger than wall thickness S1 of membrane layers G which bridge the intermediate spaces between the spring spokes E within area portions D. In the embodiment as shown the area portions D continuously are covered by said membrane layers G. Alternatively it is possible to only bridge the inner parts of the area portions D by the membrane layers G and to leave outside open passages.

The geometrical form of the area portions D having reduced wall thickness S1 can be selected voluntarily as well as the distribution and orientation of the area portions D in annular region 9 of holding membrane M. Expediently, the spring spokes E and the area portions D are regularly distributed in circumferential direction.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A yarn feeding device comprising a stationary storage body and a yarn brake including a ring-shaped braking body held axially against said storage body, said braking body including a frusto-conical and thin-walled braking band having an outer edge region which is held in a holding area of an elastic and annular holding membrane, said holding membrane being connected outwardly of said holding area with an outer carrier ring disposed concentrically to said braking band, said holding membrane defining a plurality of circumferentially distributed portions between said carrier ring and said holding area, and a plurality of spring spokes integrated into said holding membrane with each said spring spoke being disposed between an adjacent pair of said portions, and said portions having reduced wall thicknesses as compared to wall thicknesses of said spring spokes such that said portions respectively define intermediate spaces between adjacent said spring spokes, each said intermediate space being bridged by a membrane layer.

2. The yarn feeding device of claim 1, wherein said portions are distributed at uniform intervals in the circumferential direction.

3. The yarn feeding device of claim 1, wherein said holding membrane has a cross-section which defines at least one generally C-shaped bend between said holding area and said carrier ring.

4. The yarn feeding device of claim 3 wherein said braking band has an inner edge region spaced inwardly from said outer edge region thereof, said holding membrane includes a conical skirt having smooth surfaces and projecting inwardly from said C-shaped bend, and said skirt terminates adjacent said inner edge region of said braking band.

5. The yarn feeding device of claim 4 wherein said membrane includes a lip formed adjacent said holding area and extending in the circumferential direction, said lip projecting inwardly and having an inner free edge, and said lip and said skirt together define an inwardly opening and circular-shaped insertion pocket in which said outer edge region of said braking band is disposed.

6. The yarn feeding device of claim 5, wherein an inwardly extending length of said lip is about 10% to about 25% of a width of said braking band as defined between said inner and outer edge regions thereof.

7. The yarn feeding device of claim 5, wherein each said portion originates at a distance from said insertion pocket, and said distance corresponds approximately to an inwardly extending length of said lip.

8. The yarn feeding device of claim 4, wherein a wall thickness of said skirt is less than wall thicknesses of the respective spring spokes and greater than wall thicknesses of the respective membrane layers.

9. The yarn feeding device of claim 1, wherein said portions have respective widths defined in the circumferential direction which are different from widths of said spring spokes.

10. The yarn feeding device of claim 9, wherein said widths of said portions are smaller than said widths of said spring spokes.

11. The yarn feeding device of claim 1, wherein said spring spokes and said membrane layers have respective wall thicknesses, and a ratio between said wall thicknesses of said spring spokes and said wall thicknesses of said membrane layers is about 5:1.

12. The yarn feeding device of claim 11, wherein said wall thickness of each said spring spoke is about 0.1 mm and said wall thickness of each said membrane layer is about 0.2 mm.

13. The yarn feeding device of claim 1, wherein said holding membrane is a unitary and injection-molded component constructed of one of: plastic; rubber; and a Kevlar-containing compound.

14. The yarn feeding device of claim 13, wherein said holding membrane is at least semi-transparent.

15. The yarn feeding device of claim 13, wherein said holding membrane is constructed of polyurethane.

16. The yarn feeding device of claim 1, wherein said holding membrane includes an outer portion between said holding area and said carrier ring which outer portion has a generally C-shaped cross-section, an inner conical skirt which projects radially inwardly from said outer portion and has an annular inner free edge, and an annular lip which projects radially inwardly from said outer portion in spaced relation from said skirt and terminates in an annular inner free edge, said skirt and said lip together defining an annular and inwardly opening pocket in which said outer edge region of said braking band is disposed and which defines said holding area.

17. The yarn feeding device of claim 16, wherein said wall thickness of each said portion is defined at the respective said membrane layer.

18. A yarn braking body for a yarn feeding device having a stationary storage body, said yarn braking body comprising a frustoconical and thin-walled braking band having an outer edge region held in a holding area of an elastic and annular holding membrane, said holding membrane being connected outside of said holding area to an outer carrier ring arranged concentrically with respect to said braking band, said holding membrane defining a plurality of circumferentially distributed portions between said carrier ring and said holding area, and a plurality of spring spokes integrated into said holding membrane with each said spring spoke being disposed between an adjacent pair of said portions, said portions having reduced wall thicknesses as compared to wall thicknesses of said spring spokes such that said portions respectively define spaces between adjacent said spring spokes and each said space is bridged by a membrane layer.

19. The yarn braking body of claim 18, wherein said holding membrane includes an outer portion between said holding area and said carrier ring which outer portion has a generally C-shaped cross-section, an inner conical skirt which projects radially inwardly from said outer portion and has an annular inner free edge, and an annular lip which projects radially inwardly from said outer portion in spaced relation from said skirt and terminates in an annular inner free edge, said skirt and said lip together defining an annular and inwardly opening pocket in which said outer edge region of said braking band is disposed and which defines said holding area.

20. The yarn braking body of claim 19, wherein said holding membrane is a unitary, one-piece component, and is constructed of one of: plastic; rubber; and a Kevlar-containing compound.

21. The yarn braking body of claim 19, wherein said portions are distributed at uniform intervals about the circumference of said holding membrane, and said portions and said spokes are oriented substantially radially with respect to a central axis of said braking body.

* * * * *